US007744397B2

(12) United States Patent
Yeh et al.

(10) Patent No.: US 7,744,397 B2
(45) Date of Patent: Jun. 29, 2010

(54) APPARATUS AND METHOD FOR MANUFACTURING LOAD PLATES USED ON SOCKET CONNECTOR

(75) Inventors: Cheng-Chi Yeh, Tu-Cheng (TW); Jia-Hau Liu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/538,880

(22) Filed: Aug. 11, 2009

(65) Prior Publication Data

US 2010/0035458 A1 Feb. 11, 2010

(30) Foreign Application Priority Data

Aug. 11, 2008 (TW) ..... 97214365 U

(51) Int. Cl.
*H01R 4/38* (2006.01)

(52) U.S. Cl. ..... 439/331

(58) Field of Classification Search ..... 439/68, 439/71, 72, 73, 74, 331
See application file for complete search history.

(56) References Cited

U.S. PATENT DOCUMENTS

2009/0191744 A1* 7/2009 Yeh et al. ..... 439/331
2009/0221162 A1* 9/2009 Yeh ..... 439/78
2009/0233464 A1* 9/2009 Yeh ..... 439/73
2009/0246989 A1* 10/2009 Ma et al. ..... 439/135
2009/0264005 A1* 10/2009 Yeh et al. ..... 439/331

FOREIGN PATENT DOCUMENTS

TW M336587 7/2008

* cited by examiner

*Primary Examiner*—Neil Abrams
*Assistant Examiner*—Phuong Nguyen
(74) *Attorney, Agent, or Firm*—Andrew C. Cheng; Wei Te Chung; Ming Chieh Chang

(57) ABSTRACT

An electrical connector assembly comprises an insulative housing, a plurality of contacts received in the insulation housing, a linking device located in a side of the insulation housing and a load plate linking with the linking device and covering the insulation housing. The load plate has two side arms and an opening between the side arms, an expanding width of the side arm is smaller than a half of a width of the opening, two adjacent side arms of two adjacent load plates in a same row are inserted into a same opening of an opposite load plate in the other row. The electrical connector assembly can save metal material and improve manufacture efficiency.

8 Claims, 4 Drawing Sheets

APPARATUS AND METHOD FOR MANUFACTURING LOAD PLATES USED ON SOCKET CONNECTOR

BACKGROUND OF THE INVENTION

1. Field of the invention

The present invention relates to a method, and more particularly to a method of making a load plate from a metallic strip in a way that each of the load plates has its side arms interposed in an opening of two adjacent load plates so as to reduce the waste of the material.

2. Description of the prior art

Taiwanese Patent No. M336587 discloses a conventional electrical connector mounted to a printed circuit board for electrically contacting an IC package, the conventional electrical connector comprises an insulative housing, a plurality of contacts received in the insulative housing, a stiffener surrounding the insulative housing, a load plate, a lever linking the load plate and cover together. The stiffener is stamped from a metal piece and substantially has an U-shape, a stiffener strip which provides the stiffener comprises two rows of stiffener, including a row of first stiffeners and a row of second stiffener, the first stiffener and the second stiffener have a same configuration, the first stiffener has a pair of opposite first sidewalls, and the second stiffener has a pair of opposite second sidewalls, the first stiffener and an adjacent second stiffener are oppositely arranged in a manner that a space between the first sidewalls of the first stiffener receives one second sidewall of the second stiffener, another sidewall of the second stiffener located outside the space. However, the stiffener strip of the conventional electrical connector assembly still wastes some metal material.

In view of the above, a new electrical connector assembly that overcomes the above-mentioned disadvantages is desired.

SUMMARY OF THE INVENTION

Accordingly, an object of the present invention is to provide an electrical connector assembly, which can save metal material and improve a manufacture efficiency.

To fulfill the above-mentioned object, an electrical connector assembly, comprises: an insulative housing, a plurality of contacts and a load plate, a contacts received in the insulative housing, a load plate covering the insulation housing, the load plate has two side arms and an opening between the side arms, an expanding width of the side arm being smaller than a half of a width of the opening.

Other objects, advantages and novel features of the invention will become more apparent from the following detailed description when taken in conjunction with the accompanying drawings.

DETAILED DESCRIPTION OF THE PREFERRED EMBODIMENT

Reference will now be made to the drawings to describe the present invention in detail.

Figure 1:
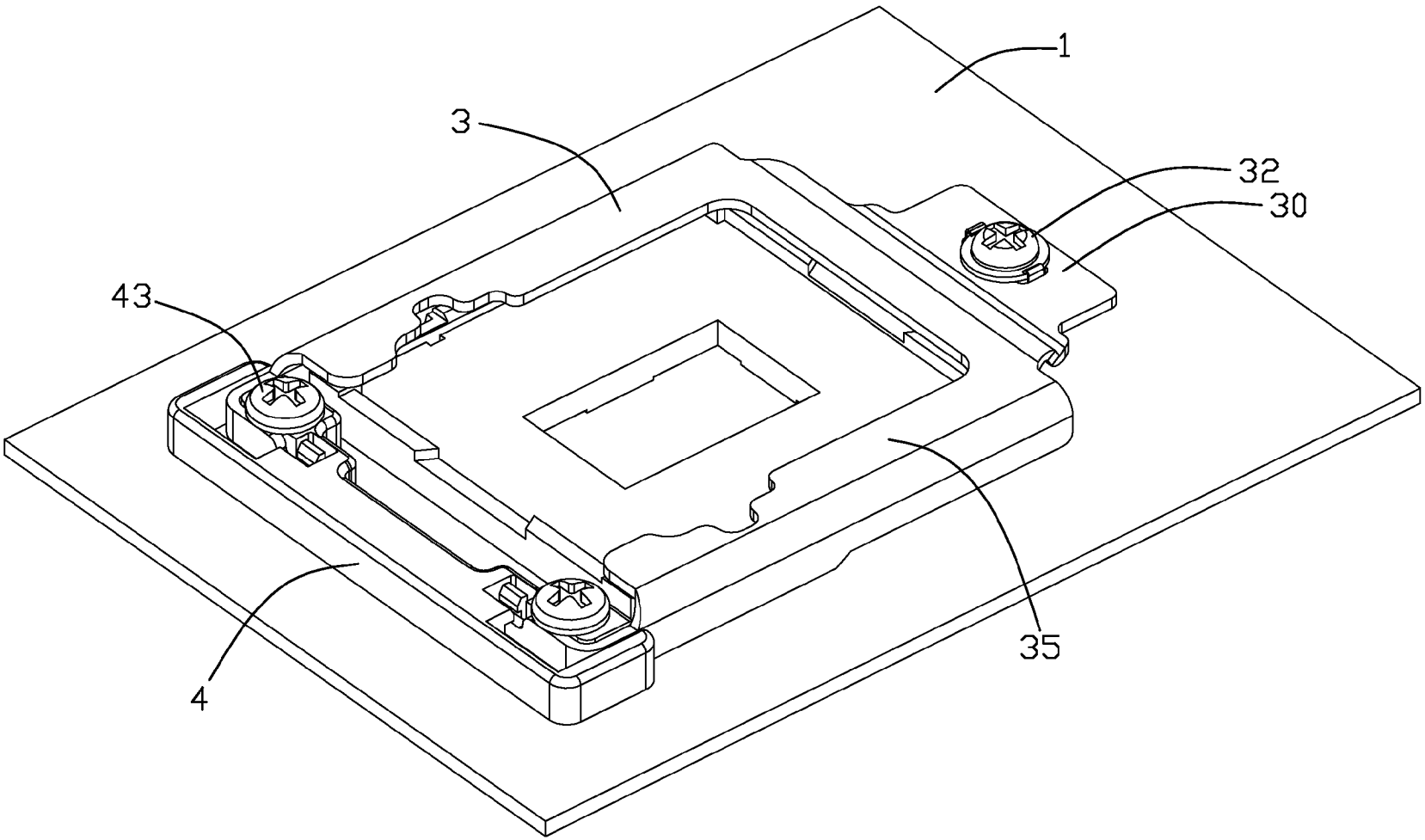
FIG. 1 is an assembly, perspective view of an electrical connector assembly in accordance with present invention.
Figure 2:
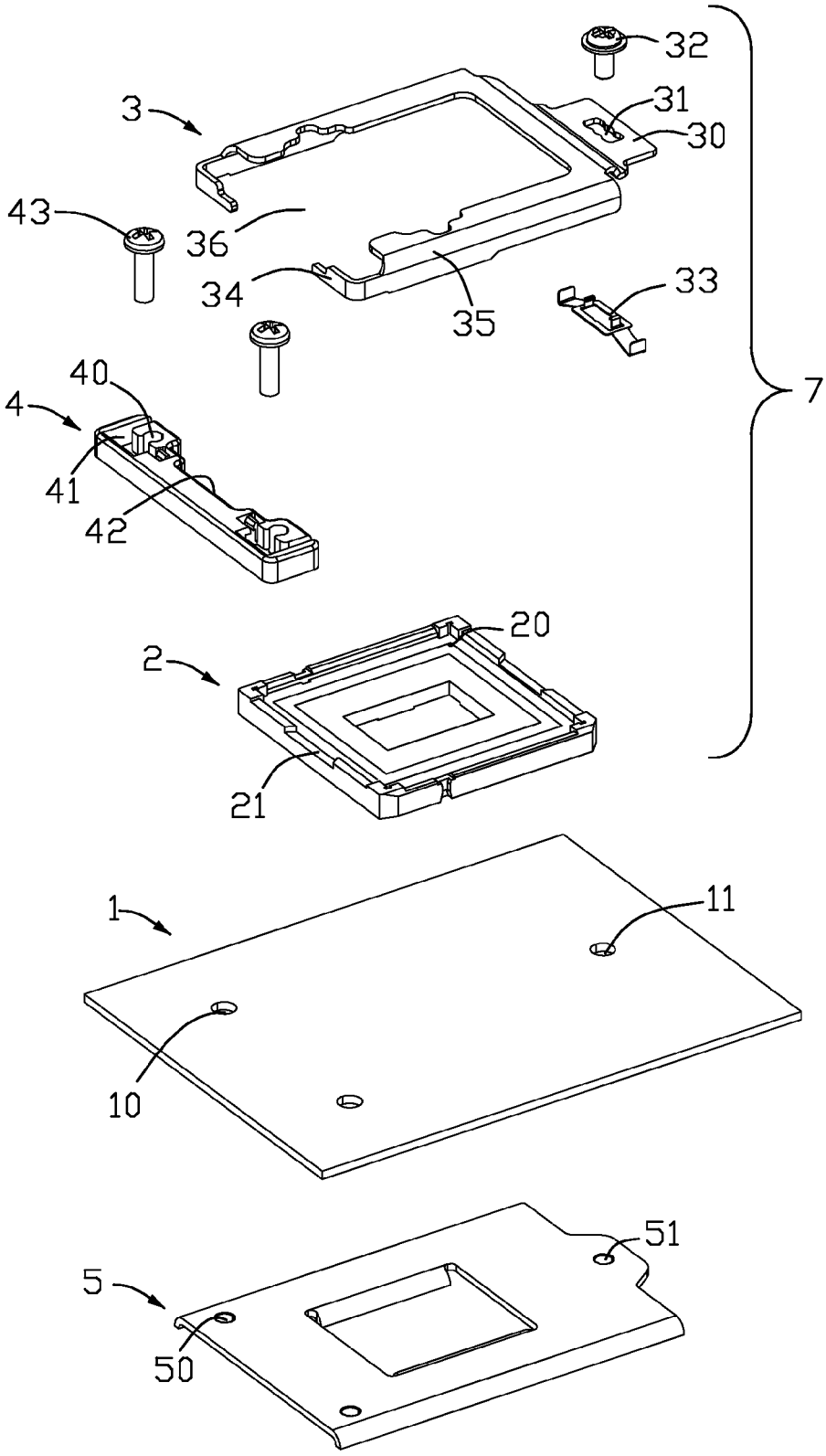
FIG. 2 is an exploded, perspective view of the electrical connector assembly of FIG. 1.
Figure 3:
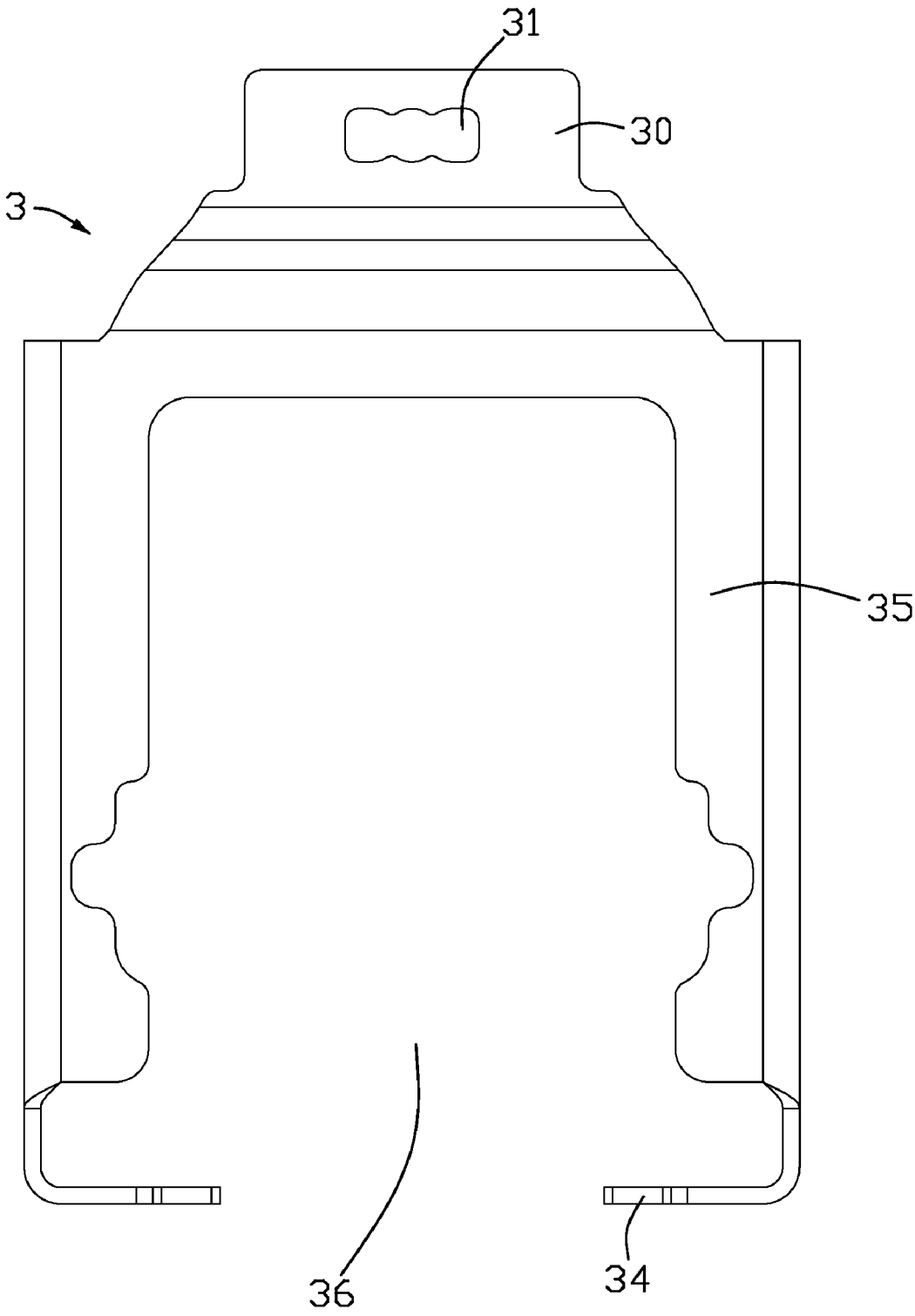
FIG. 3 is a top view of a load plate of the electrical connector.

Referring to FIGS. 1-3, an electrical connector assembly 7 made in accordance with the present invention comprises a printed circuit board 1, an insulative housing 2 mounted onto the printed circuit board 1. A linking device 4 mounted onto the printed circuit board 1 and adjacent to a first side of the insulative housing 2 by means of a back plate 5 disposed on the other side of the printed circuit board 1. A load plate 3 is pivotally assembled onto the linking device 4 for rotating between a first position in which the insulative housing 2 is free to access and a second position in which its main portion covers substantially the insulative housing 2, a fastener 32 disposed on a tongue portion 30 of the load plate 3 and mounted on the printed circuit board 1 for securely retaining the tongue portion 30 of the load plate 3 by means of the fastener 32, which is a screw according to the present embodiment.

The printed circuit board 1 has a pair of first through holes 10 at a first end thereof and a second through hole 11 at a second end thereof. The back plate 5 is located at the bottom side of the printed circuit board 1 and has a pair of first screwing holes 50 corresponding to the first through holes 10 and a second screwing hole 51 corresponding to the second through hole 11 of the printed circuit board 1.

Referring to FIGS. 2, the insulative housing 2 is configured to a rectangle shape, and defines a plurality of contacting holes 20 for receiving a plurality of contacts (not shown). The insulative housing 2 has a pair of recesses 21 on central parts of two opposite sides thereof. The linking device 4 is mounted to the printed circuit board 1. The linking device 4 is a substantially U-shaped configuration and includes two contacting holes 40 on two ends thereof and a recessed portion 42 between the two contacting holes 40. A right-angled slot 41 is recessed from a top surface thereof and communicating with the contacting hole 40. The linking device 4 further includes two pin members, such as bolts 43, which are received in the corresponding contacting holes 40 and pass through the first though holes 10 of the printed circuit board 1 and finally are screwed into the first screwing holes 50 of the back plate 5. Thus, the linking device 4 is reinforced on the printed circuit board 1 by the back plate 5.

Referring to FIGS. 2-3, the load plate 3 is stamped from a metal piece and also has a U-shape configuration. The load plate 3 has the tongue portion 30 extending forwardly and defining a hole 31 for receiving the fastener 32, and the fastener 32 is attached to the tongue portion 30 of the load plate 3 by an indicator 33. The load plate 3 has two side arms 35, each side arm 35 includes a horizontal portion and a side portion extending downwardly from the horizontal portion and covering out sides of the insulative housing 2, an opening 36 defined between the side arms 35. Each side arm 35 of the load plate 3 has an orthogonal pivotal portion 34 bent from a free end thereof and contained into the corresponding slot 41 of the linking device 4 to pivotally assemble the load plate 3 to the linking device 4 to cover the insulative housing 2. Moreover, top edges of the pivotal portions 34 are restrained by heads of the two bolts 43, respectively. Thus, when the load plate 3 is rotated, stresses produced by the pivotal portions 34 are shared by the two bolts 43.

Figure 4:
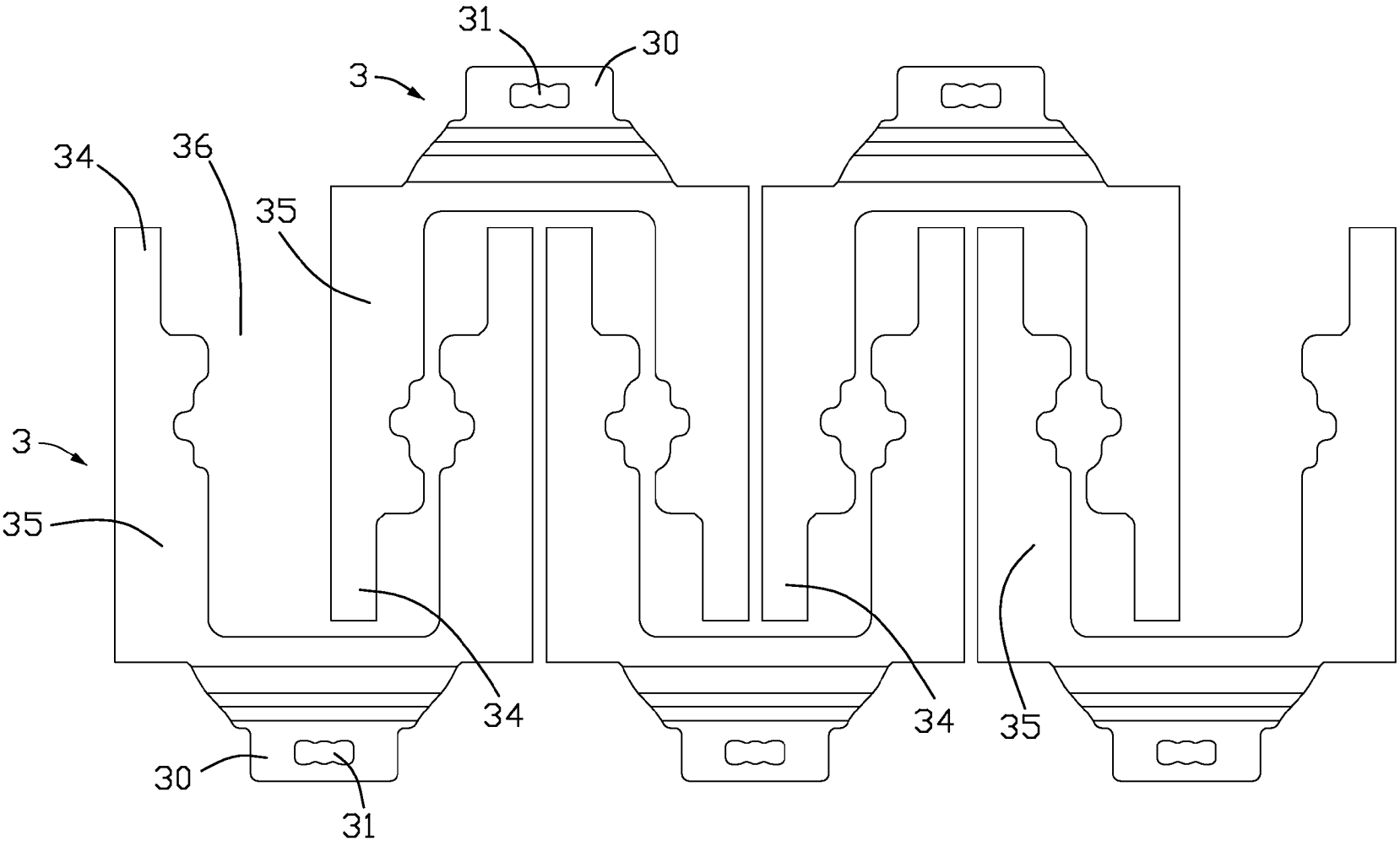
FIG. 4 is a top view a load plate strip in which a plurality of the load plates are arranged.

Referring to FIG. 4, showing a load plate strip in which a plurality of the load plates 3 are arranged, the load plate 3 is in an expanding state without any bending. The load plate strip has two rows of the load plates 3 which are oppositely arranged in different rows, an expanding width of the side arms 35 is smaller than a half of a width of the opening 36, so two adjacent side arms 35 of each two adjacent load plates 3 in a same row are inserted into a same opening 36 of an opposed load plate 3 in the other row, in another word, two side arms 35 of each load plate 3 are inserted into two openings 36 of two opposite and adjacent load plates 3, respectively. By this arrange manner of the load plates 3 on the strip, most of the metal material which is corresponding to the opening 36 of the load plate 3 and is originally wasted by stamping can be newly used. The electrical connector assembly 7 can save metal material and improve manufacture efficiency.

FIG. 4 describes how the load plate 3 made in accordance with the present invention is made in an efficient way in which maximum material of a metallic strip can used to make the load plate.

Furthermore, although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector assembly for mounting the IC package on the printed circuit board (PCB), comprising:

an insulative housing;

a plurality of contacts received in the insulative housing;

a printed circuit board;

a back plate;

a linking device mounted onto the printed circuit board and adjacent to a side of the insulative housing;

a load plate covering the insulation housing and comprising two side arms and an opening between the side arms, an expanding width of the side arm being smaller than a half of a width of the opening; and a fastener and wherein the load plate has a tongue portion extending forwardly and defining a hole for receiving the fastener, the fastener is attached to the tongue portion of the load plate;

the linking device has two bolts and two slots, the load plate has two orthogonal pivotal portions bent from a free end thereof and contained into corresponding slots of the linking device, and top edges of the pivotal portions are restrained by heads of the two bolts.

2. The electrical connector assembly as claimed in claim 1, wherein the load plate is of a U-shape configuration and defines the opening in a center thereof, and the opening receives two adjacent side arms of two another adjacent load plates when the load plate is in a load plate strip.

3. The electrical connector assembly as claimed in claim 1, wherein the printed circuit board has a pair of first through holes at a first end thereof and a second through hole at a second end thereof.

4. The electrical connector assembly as claimed in claim 3, wherein the back plate is located at a bottom side of the printed circuit board and has a pair of first screwing holes corresponding to the first through holes and a second screwing hole corresponding to the second through hole of the printed circuit board.

5. The electrical connector assembly as claimed in claim 4, wherein the linking device has contacting holes on two ends thereof and the bolts pass through the contacting holes of the linking device to mount the linking device on a printed circuit board and are located on a side of the insulative housing.

6. A method of forming a metal plate strip for loading upon the IC package on the printed circuit board PCB comprising:

providing an insulative housing;

providing a plurality of contacts in the insulative housing;

providing a printed circuit board;

providing a linking device mounted onto the printed circuit board and a back plate;

arranging a plurality of metal plates in two opposite rows, each metal plate being of a U-shape with two opposite side arms and an opening between the side arms, the opening of the metal plate in one of the rows receiving two side arms of two adjacent metal plates in the other row;

providing the metal plate with a tongue portion located on a front of the load plate and extending forwardly and two pivotal portions inwardly bent at free ends the side arms;

loading one metal plate on the insulation housing;

fastening the tongue portion by a hole;

providing the linking device with two bolts and two slots;

fastening the two orthogonal pivotal portions of each metal plate with corresponding slots of the linking device and top edges of the pivotal portions by heads of the two bolts.

7. The method of forming the metal plate strip as claimed in claim 6, further including inserting the bolts through contacting holes defined on the linking device to fasten the insulative housing on the printed circuit board.

8. An electrical connector assembly for mounting the IC package on the printed circuit board (PCB), comprising:

an insulative rectangular housing having an upward receiving cavity in an upper face and defining a lengthwise direction and a transverse direction perpendicular to each other;

a plurality of contacts disposed in the housing with contacting sections upwardly extending into the receiving cavity; and a printed circuit board;

a linking device mounted onto the printed circuit board;

a load plate positioned upon the housing and defining a U-shaped configuration in a top view; wherein said U-shaped configuration includes a pair of side arms each with thereof a maximum width along said transverse direction, and a space between said pair of side arms along said transverse direction is dimensioned at least two times of said maximum width so as to allow material corresponding to said space to be able to be formed as the side arms of other two load plates in a same row carrier during production of said load plate;

the load plate has two orthogonal pivotal portions bent from a free end thereof and connected into corresponding slots defined on the linking device, and top edges of the pivotal portions restrained by heads of two bolts.

* * * * *